United States Patent [19]

Milliman

[11] 4,422,433

[45] Dec. 27, 1983

[54] PROJECTILE LOADER AND DETENT ASSEMBLY FOR GUNS

[75] Inventor: Keith Milliman, Fairport, N.Y.

[73] Assignee: The Coleman Company, Inc., Wichita, Kans.

[21] Appl. No.: 381,150

[22] Filed: May 24, 1982

[51] Int. Cl.[3] ..... F41B 11/06

[52] U.S. Cl. ..... 124/74; 124/41 C; 124/48

[58] Field of Search ..... 124/48, 41 C, 41 R, 124/74, 76; 42/59

[56] References Cited

U.S. PATENT DOCUMENTS 2,866,386 12/1958 Lucht ..... 42/59 X 3,212,489 10/1965 Merz ..... 124/48 X 3,616,561 11/1971 Hendricks ..... 42/59 X 3,913,553 10/1975 Braughler et al. ..... 124/48 X

*Primary Examiner*—Richard T. Stouffer

*Assistant Examiner*—William H. Honaker

[57] ABSTRACT

A gas-powered gun includes a movable loader for moving projectiles into alignment with the barrel of the gun and a detent engageable with the loader for retaining a protectile in the firing position. The loader is provided with projectile ports for holding the projectiles, and the detent is engageable with each port as it moves into alignment with the barrel. The detent is slidably mounted within a detent holder, and the detent holder is connected to a source of pressurized gas. A gas passage extends through the detent, and when the gun is fired, pressurized gas flows through the detent and propels the projectile through the barrel.

11 Claims, 11 Drawing Figures

FIG. 8
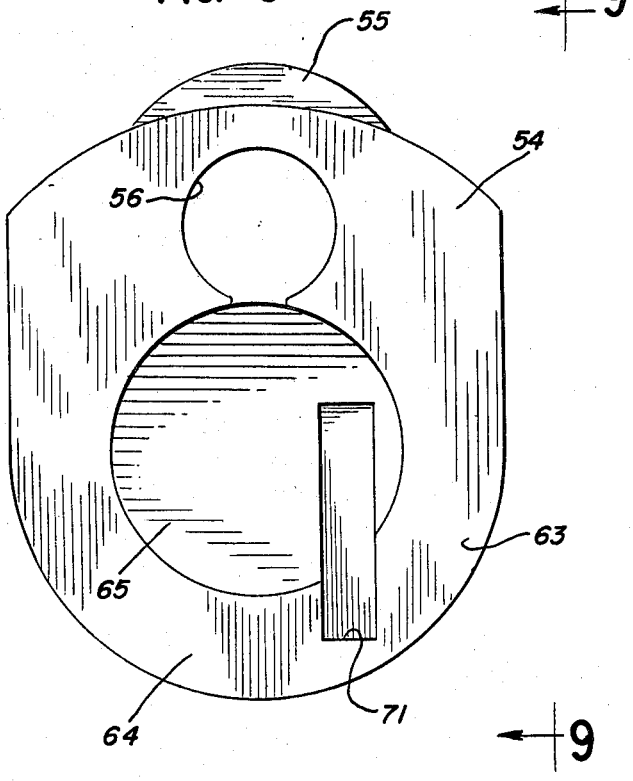
FIG. 9
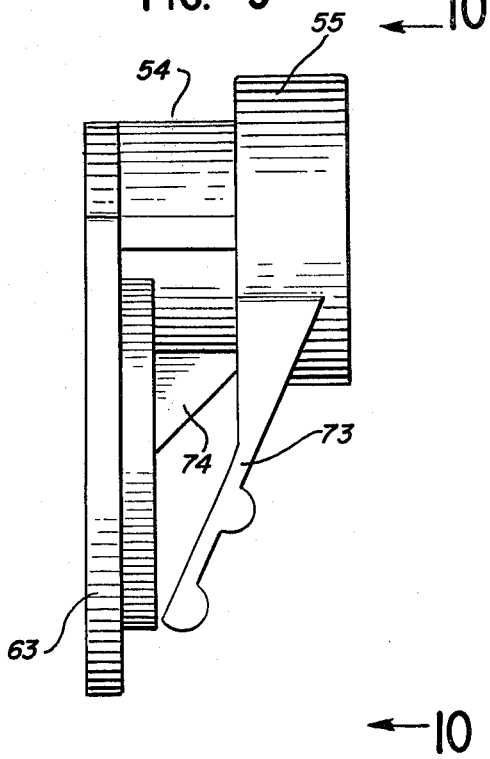
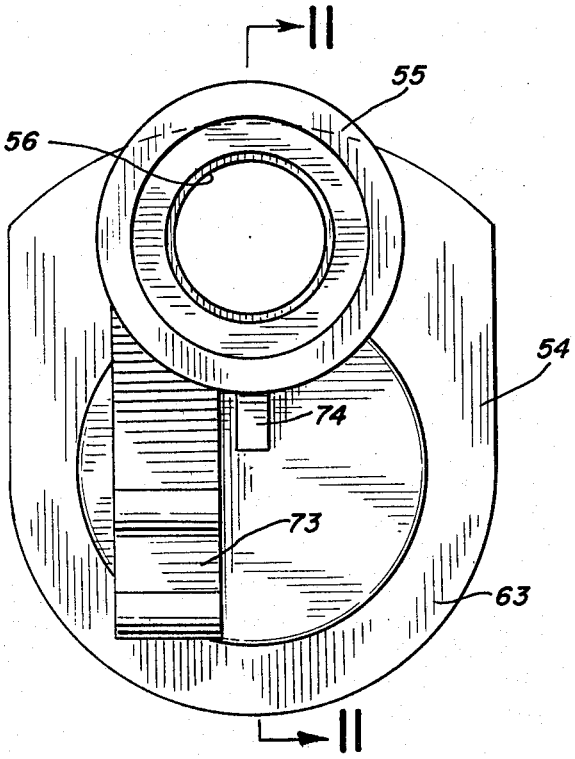
FIG. 10
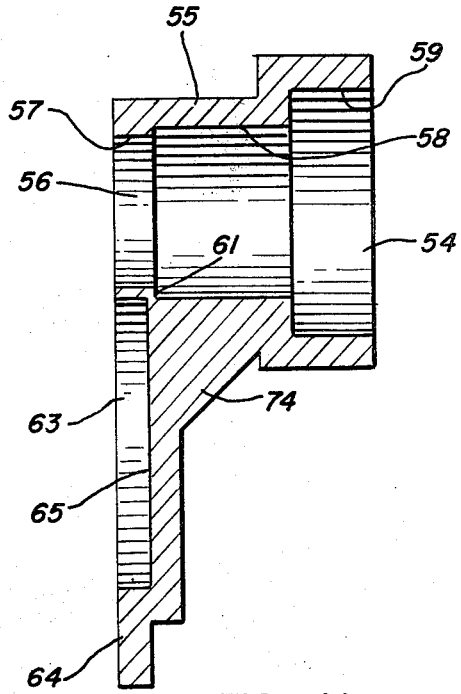
FIG. 11

PROJECTILE LOADER AND DETENT ASSEMBLY FOR GUNS

BACKGROUND AND SUMMARY

This invention relates to gas-powered guns, and, more particularly, to a loader and detent assembly for gas-powdered guns.

Some gas-powered guns are provided with swing, linear, or rotary loaders which hold a plurality of projectiles. The loaders are movable to bring each projectile into a firing position in which the projectile is aligned with the barrel of the gun.

Gas-powered guns which are equipped with loaders require close tolerances and/or gas seals to minimize gas loss between the source of pressurized gas, the loader, and the barrel. Close tolerances increase the cost of manufacturing the guns. Gas seals increase the number of parts and also increase the manufacturing expense and the complexity of the gun.

The invention provides a loader assembly which minimizes gas leakage while permitting liberal manufacturing tolerances. A detent is engageable with each projectile port in the loader for maintaining the projectile port in alignment with the barrel. The detent is forced against the loader by a spring, and the loader is thereby forced against the barrel to seal the detent, the loader, and the barrel. The detent is generally cylindrical and is provided with a gas passage therethrough. When the gun is fired, pressurized gas provides an additional sealing force against the detent.

DESCRIPTION OF THE DRAWING

The invention will be explained in conjunction with an illustrative embodiment shown in the accompany drawing, in which:

FIG. 8 is a front end elevational view of the detent holder;

FIG. 9 is a side elevational view of the detent holder taken along the line 9—9 of FIG. 8;

FIG. 10 is a rear elevational view of the detent holder taken along the line 10—10 of FIG. 9; and FIG. 11 is a sectional view taken along the line 11—11 of FIG. 10.

DESCRIPTION OF SPECIFIC EMBODIMENT

Figure 1:
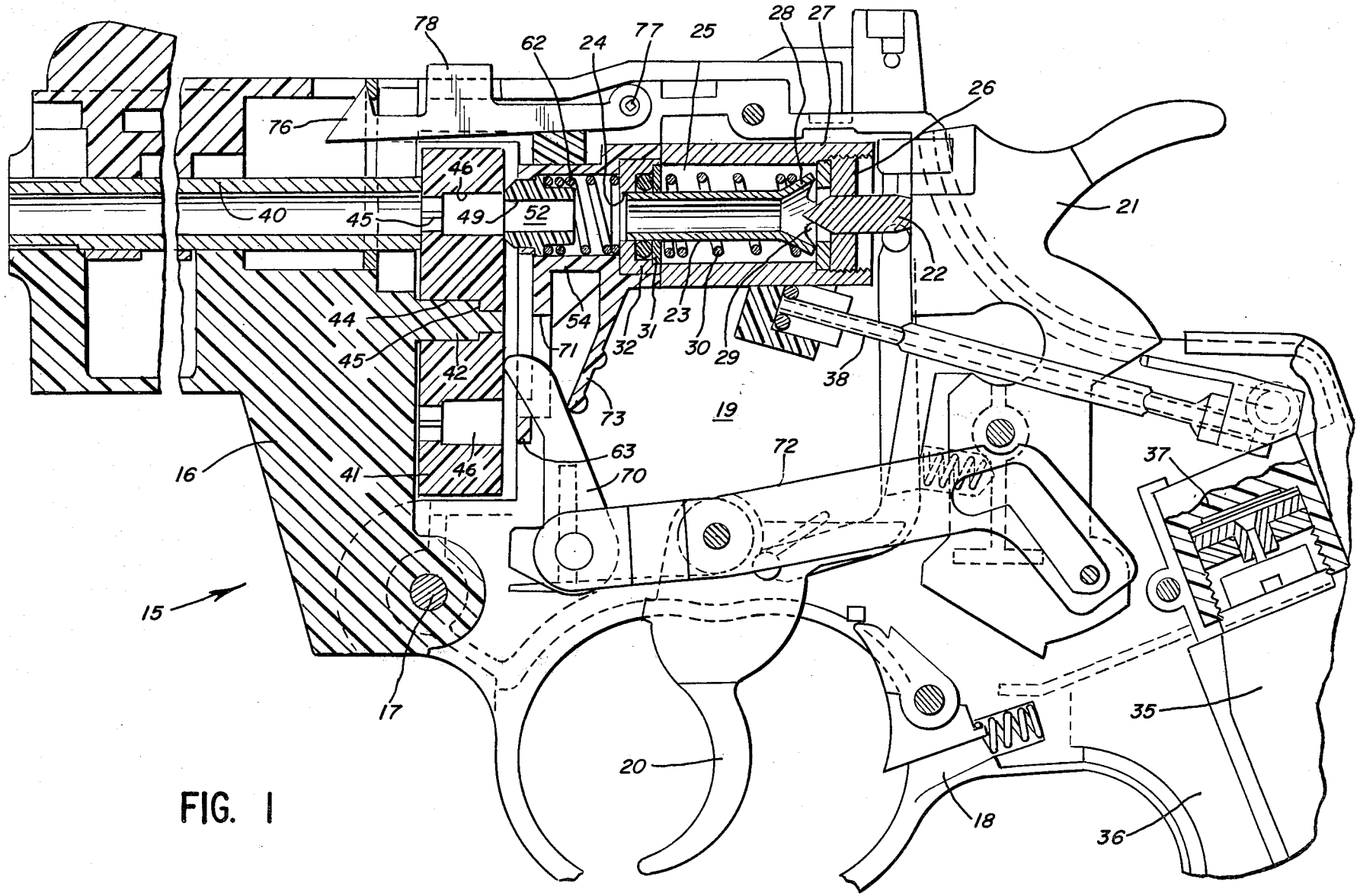
FIG. 1 is a fragmentary sectional view of a pistol which is equipped with a loader and detent assembly in accordance with the invention.

Referring first to FIG. 1, the numeral 15 designates generally a gas-powered pistol. The pistol is conventional except for the loader and detent assembly, and the pistol need not be explained in detail. The pistol includes a barrel body 16 which is pivotally secured by a pin 17 to a pair of mating frame halves 18. The frame halves provide an enclosure 19 in which the parts of the gun are mounted.

A trigger 20 operates a hammer 21, and the hammer 21 strikes a pin 22 when the hammer is released. The pin 22 is formed integrally with a tubular valve stem 23. The forward end of the valve stem is slidably mounted in an opening 24 in a valve body 25. A cap 26 is threadedly engaged with the rear end of the valve body and an annular washer 27 is positioned against the cap. The pin 22 extends through the washer 27 and the cap 26, and the valve stem 23 is flared outwardly to provide a frusto-conical portion 28. A pair of diametrically opposed openings 29 provide a gas passage through the frusto-conical portion.

A coil spring 30 engages the outside of the frusto-conical portion of the valve stem and urges the frusto-conical portion into sealing engagement with the washer 27. The other end of the coil spring engages a washer 31 which is held against an internal shoulder in the valve body and in sealing engagement with an O-ring 32.

Pressurized gas is supplied to the valve body 25 by a $CO_2$ cartridge 35 which is mounted in the handle portion 36 of the frame. The $CO_2$ gas flows through a cartridge-piercing assembly 37 and through a connecting tube assembly 38 to the valve body.

The inside of the valve stem 23 within the valve body is ordinarily an atmospheric pressure. The $CO_2$ gas is sealed in the space surrounding the valve stem by the seals 27 and 32. However, when the gun is fired and the hammer 21 strikes the pin 22, the pin is forced to the left in FIG. 1 and moves the frusto-conical portion of the valve stem away from the seal 27. Pressurized $CO_2$ is thereby allowed to flow from the valve body 25 through the openings 29 and the inside of the valve stem to fire the projectile which will be described hereinafter. It will be understood that the gun may be powered by gases other than $CO_2$, e.g., pressurized air.

A tubular barrel 40 is mounted within the barrel body 16, and a cylindrical loader 41 is rotatably mounted on the barrel body adjacent the rear end of the barrel. The loader is mounted on a pin or stud 42 which extends rearwardly from the barrel body. The stud extends into a central bore 44 in the loader, and an annular step 45 in the central bore engages a corresponding step on the stud 42.

Figure 4:
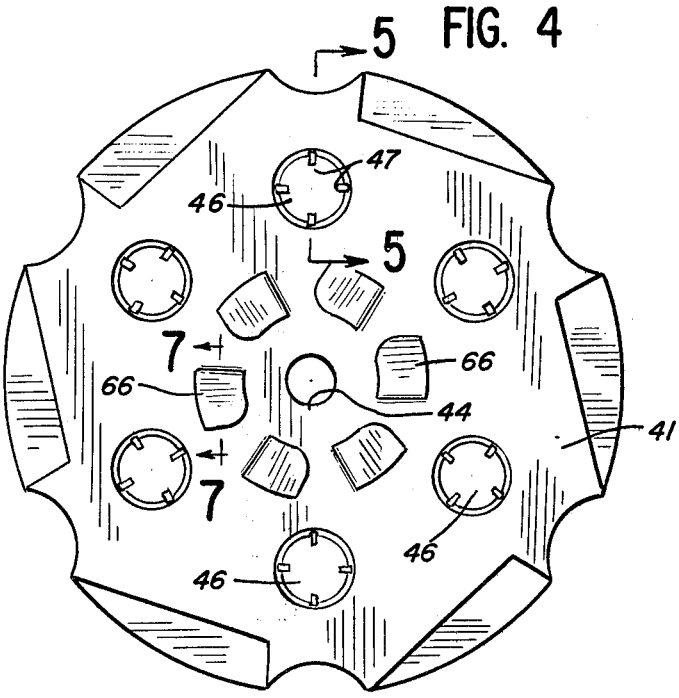
FIG. 4 is a rear end elevational view of the loader.
Figure 5:
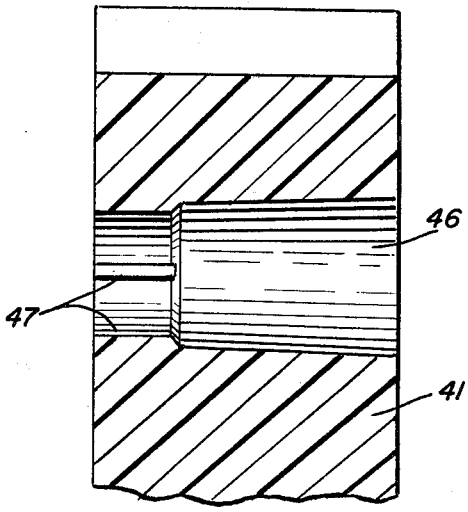
FIG. 5 is an enlarged fragmentary sectional view taken along the line 5—5 of FIG. 4.

The loader is provided with a plurality of projectile ports 46, and each projectile port is alignable with the barrel 40 as the loader revolves or rotates on the stud 42. The forward end of each projectile port includes four circularly spaced ribs 47 (see also FIGS. 4 and 5) which are tapered inwardly and forwardly to retain the projectile within the port until the gun is fired. The particular ports illustrated are designed for use with pellets, but the ports could be designed for BB's or other types of projectiles.

Figure 2:
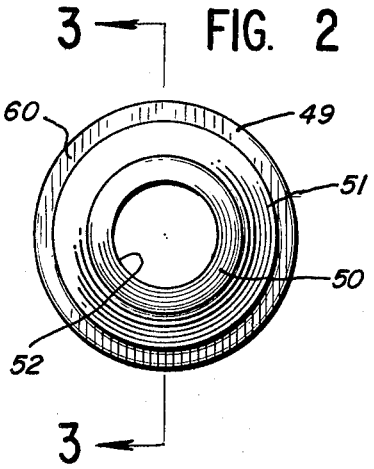
FIG. 2 is a front end elevational view of the detent.
Figure 3:
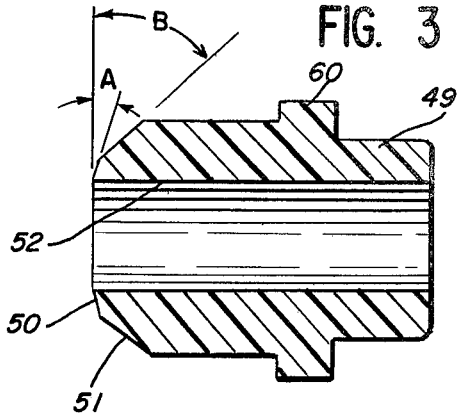
FIG. 3 is a sectional view of the detent taken along the line 3—3 of FIG. 2.

The rear end of each projectile port is flared outwardly slightly (see FIG. 5), and as each projectile port moves into alignment with the barrel 40, the rear end of the port is engaged by a generally cylindrical detent 49. Referring to FIGS. 2 and 3, the detent 49 includes a somewhat bullet-shaped forward nose which is provided by a first tapered portion 50 and a second tapered portion 51. The first tapered portion 50 is much flatter than the second tapered portion and is designed to provide a slight detenting force against the loader as the detent engages a projectile port. In one particular embodiment, the diameter of each projectile port at the rear end thereof, i.e., the end engaged by the detent, was 0.187 inch, and the port tapered inwardly to a diameter of 0.1775 at the ribs 47. The diameter of a circle circumscribed by the ribs was 0.168 inch. The first flared portion 50 of the detent was flared at an angle A of 8° and had an outside diameter of 0.203 inch. The second flared portion 51 was flared at an angle B of 45°. Both the loader and the detent were molded from Acetal plastic.

The detent is provided with a central bore 52 through which pressurized gas flows from the valve body 25 to the projectile port to propel the projectile through the barrel. The detent is slidably mounted within a detent holder 54 which extends between the valve body 25 and the loader 41. The details of the detent holder are shown in FIGS. 8–11. The detent holders includes an upper generally cylindrical portion 55 having a central bore 56. The inside surface of the cylindrical portion includes three radially stepped portions 57, 58, and 59 (FIG. 11). The large diameter portion 59 of the bore of the detent holder fits over the forward end of the valve body 25 as shown in FIG. 1, and the forward end of the detent 49 is slidably mounted in the small diameter portion 57 of the bore of the detent holder. An annular shoulder 60 (FIG. 3) on the detent is slidably mounted within the intermediate portion 58 of the bore of the detent holder, and the shoulder 60 is engageable with the shoulder 61 in the bore of the detent holder between the radially stepped portions 57 and 58 of the bore. A coil spring 62 (FIG. 1) extends between the shoulder 60 on the detent and the forward end of the valve body to resiliently bias the detent toward the loader.

Figure 6:
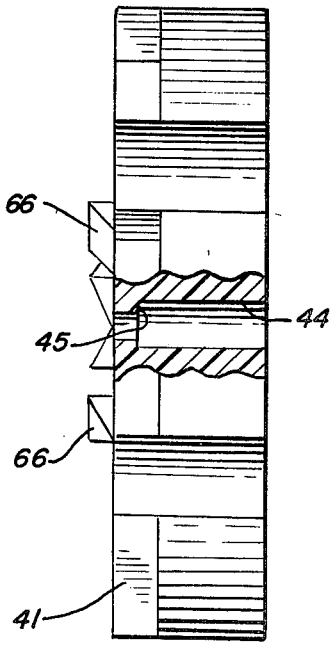
FIG. 6 is a side elevational view, partially broken away, of the loader.
Figure 7:
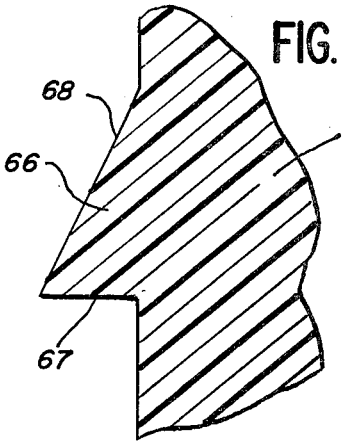
FIG. 7 is an enlarged fragmentary sectional view of one of the indexing ramps of the loader taken along the line 7—7 of FIG. 4.

The detent holder also includes a projectile holding plate 63 which extends downwardly from the forward end of the cylindrical portion of the projectile holder. The projectile holding plate 63 has a generally circular peripheral portion 64 (FIGS. 8 and 11) which extends around the circular arc through which the projectile ports of the loader rotate and prevents the projectiles from falling rearwardly out of the ports. The projectile holding plate is provided with a central recessed portion 65 to accommodate a plurality of ratchet teeth 66 (FIGS. 4 and 6) which are positioned around the central bore 44 on the rear face of the loader 41. Each ratchet tooth includes a flat indexing surface 67 (FIG. 7) which extends perpendicularly from the rear face of the loader and an inclined surface 68.

An index pawl 70 (FIG. 1) extends through a rectangular slot 71 (FIG. 8) in the projectile holding plate 63 of the detent holder. A conventional indexing link mechanism 72 raises the pawl 70 as the trigger is pulled, and as the pawl is raised it engages the indexing surface 67 of one of the ratchet teeth to rotate the loader and bring one of the projectile ports into alignment with the barrel. A spring plate 73 (FIGS. 9 and 10) is molded integrally on the detent holder and extends downwardly from the rear portion 55 of the detent holder into engagement with the index pawl 70. The spring plate holds the index pawl against the ratchet teeth of the loader and eliminates the need for a secondary spring. The detent holder also includes a reinforcing rib 74 (FIGS. 9–11) between the cylindircal portion of the detent holder and the projectile holding plate of the detent holder.

Referring again to FIG. 1, a latch 76 is pivotally mounted in the top of the pistol by a pin 77 and retains the barrel body 16 in the closed position illustrated. The barrel body 16 can be pivoted about the pin 17 by depressing the button portion 78 of the latch to disengage the latch from the barrel body, and when the barrel body is pivoted away from the pistol frame, the rear face of the loader 41 is exposed to permit projectiles to be inserted into the projectile ports. The detent 49 is retained in the detent holder when the gun is open by the engagement of the shoulder 60 (FIG. 3) on the detent with the shoulder 61 (FIG. 11) in the detent holder.

The detent 49, detent body 54, and loader are all advantageously formed from plastic, such as Acetal, which allows a low coefficient of friction and smoother and easier operation of the mechanism. The detent and detent body are designed to provide minimal or no clearance between the detent and the detent body and between the detent body and the valve body 24, thereby eliminating the need for secondary seals in these areas to prevent leakage of $CO_2$.

When the trigger is pulled to fire the gun, the index pawl rotates the loader to bring a projectile port into alignment with the barrel. The projectile port is aligned with the barrel just prior to the release of the hammer 21, and as the port becomes aligned with the barrel the flared forward nose of the detent is pushed into the rear of the port to provide resistance to further rotation of the loader. The nose of the detent is relatively blunt and therefore provides a relatively low detenting force on the loader. However, the relatively low detenting force provided by the detent is sufficient because as the gun is fired and $CO_2$ gas surges through the valve stem 23 and against the detent, the detent is forced tightly against the loader and the loader is forced tightly against the barrel to effectively lock the port in proper alignment with the barrel and to provide an effective gas seal which minimizes leakage of $CO_2$. The relatively low detenting action permits lighter and smoother operation of the gun by lowering the frictional resistance to rotation of the loader. The detent design also permits the gun to be designed for break-open action to facilitate loading of ammunition and removal of jammed ammunition.

The loader and detent are designed to insure adequate clearance between the barrel and the detent body for rotation of the loader. The detent extends into this clearance and pushes the loader against the barrel during firing, thereby eliminating any excessive clearance between the parts. Slight dimensional variances in the parts will not lessen the effectiveness of the detent in eliminating excessive clearances.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A gas-powered gun having a barrel and means for supplying pressurized gas and a projectile loader assembly therefor, the loader assembly comprising a loader having a plurality of projectile ports, the loader being movably mounted in the gun to permit the projectile ports to be aligned with the barrel, a detent holder connected to the gas-supplying means, a detent mounted in the detent holder in alignment with the barrel, the detent having an end portion which is engageable with the projectile ports of the loader, and means for urging the detent against the loader whereby the detent provides a retaining force on the loader when a projectile port is aligned with the barrel, the detent being provided with a gas passage therethrough whereby pressurized gas can flow from the detent holder to the projectile port when the gun is fired.

2. The assembly of claim 1 in which said end portion of the detent is tapered.

3. The assembly of claim 1 in which said means for urging the detent comprises a spring.

4. The assembly of claim 1 in which the loader is rotatably mounted in the gun.

5. The structure of claim 1 in which each of the projectile ports includes means for retaining a projectile in the port.

6. The assembly of claim 5 in which the retaining means includes circumferentially spaced ribs.

7. The assembly of claim 1 including retaining means on the detent holder for retaining projectiles in the projectile ports which are not aligned with the barrel.

8. The assembly of claim 1 in which the gun includes indexing means for moving the loader to bring a projectile port into alignment with the barrel, the detent holder including a flexible and resilient spring means for urging the indexing means against the loader.

9. The assembly of claim 1 in which the detent holder includes a cylindrical portion and a radially inwardly extending shoulder on the cylindrical portion, the detent being generally cylindrical and being mounted within the cylindrical portion for axial sliding movement therein, the shoulder being engageable with the detent for retaining the detent within the sleeve.

10. The assembly of claim 9 in which said means for urging the detent comprises a coil spring within the cylindrical portion of the detent holder.

11. The assembly of claim 10 including a radially outwardly extending shoulder on the detent which is engageable with the shoulder on the cylindrical portion of the detent holder, the spring engaging the shoulder on the detent.

* * * * *